US005080816A

United States Patent [19]

Sakamoto et al.

[11] Patent Number: 5,080,816

[45] Date of Patent: Jan. 14, 1992

[54] LUBRICANT FOR REFRIGERATING MACHINE

[75] Inventors: Tetsuro Sakamoto, Yokohama; Motoshi Sunami, Nerima; Hiroshi Hasegawa, Yokohama, all of Japan

[73] Assignee: Nippon Oil Co., Ltd., Tokyo, Japan

[21] Appl. No.: 564,074

[22] Filed: Aug. 8, 1990

[30] Foreign Application Priority Data

Aug. 11, 1989 [JP] Japan ..... 1-206661

[51] Int. Cl.[5] ..... C10M 105/18

[52] U.S. Cl. ..... 252/52 A; 252/54

[58] Field of Search ..... 252/52 A, 54, 68, 58, 252/67; 62/114

[56] References Cited

U.S. PATENT DOCUMENTS

| | | | |
|---|---|---|---|
| 1,510,759 | 10/1924 | Buch et al. | 62/114 |
| 2,017,811 | 10/1935 | Cox | 252/54 |
| 2,582,306 | 1/1952 | Zellhoefer et al. | 252/68 |
| 2,665,312 | 1/1954 | Ohlmann et al. | 252/68 |
| 4,755,316 | 7/1988 | Magid et al. | 252/68 |
| 4,851,144 | 7/1989 | McGraw et al. | 252/68 |
| 4,900,463 | 2/1990 | Thomas et al. | 252/68 |
| 4,916,914 | 4/1990 | Short | 62/114 |

FOREIGN PATENT DOCUMENTS 343662 11/1989 European Pat. Off. .

*Primary Examiner*—Margaret B. Medley

*Attorney, Agent, or Firm*—Cushman, Darby & Cushman

[57] ABSTRACT

A lubricant for a refrigerating machine is here disclosed which comprises a polyether represented by the general formula

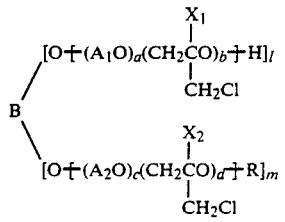

wherein B is a residue of a compound having 2 to 8 hydroxyl groups, $A_1O$ and $A_2O$ may be identical or different, each of them is an oxyalkylene group having 2 to 18 carbon atoms, $X_1$ and $X_2$ may be identical or different, each of them is hydrogen or a methyl group, R is hydrogen or a hydrocarbon group having 1 to 24 carbon atoms, a is an integer of from 0 to 100, b is an integer of from 1 to 100, c is an integer of from 0 to 100, d is an integer of from 0 to 100, the oxyalkylene group and the chlorine-containing group in the parentheses { } may be each combined by random copolymerization or block copolymerization, l is an integer of from 1 to 8, m is an integer of from 0 to 7, and l +m is an integer of from 2 to 8.

The lubricant of the present case is particularly excellent in lubricating properties.

3 Claims, No Drawings

LUBRICANT FOR REFRIGERATING MACHINE

BACKGROUND OF THE INVENTION (i) Field of the Invention

The present invention relates to a lubricant for a refrigerating machine, and more specifically, it relates to a lubricant for a refrigerating machine, which contains a chlorinated polyether having a specific structure and which is excellent in lubricating properties.

(ii) Description of the Prior Art

Examples of FLON refrigerants used in refrigerating machines include CFC (chloro-fluoro-carbon) typified by R11, R12 and R13, HCFC (hydrochloro-fluoro-carbon) typified by R22 and R142b, and HFC (hydro-fluoro-carbon) typified by R134a.

It is known that lubricating properties on the sliding portion of the compressor of a refrigerating machine are improved by a FLON refrigerant containing chlorine, particularly by the function of chlorine present in its molecule. However, a FLON such as CFC in which all the hydrogens of the hydrocarbon are replaced with halogen atoms is difficult to decompose in the atmosphere, which leads to the breakage of an ozone layer. For this reason, limitations of production and consumption of CFC are being planned by the International Convention. Therefore, in the place of CFC, refrigerants such as HCF and HFC will be used in the future, but in these refrigerants, the content of chlorine is lower than in CFC, and the improvement effect of the lubricating properties is less than in CFC. In consequence, the lubricant to be used is required to be more excellent in the lubricating properties.

Of the refrigerating machines using the FLON refrigerant, the machines having rotary type compressors, even if being of small size, have a high refrigerating power and a less noise at the time of operation, and so they are widely used in domestic refrigerators, room air conditioners, car air conditioners and the like. With regard to this type of refrigerating machines, however, surface pressure in the sliding portion of the compressor is high and sliding velocity is also high, and therefore with regard to the lubricating properties of the lubricant, requirements are heightened more and more along with the performance enhancement of the compressor.

Heretofore, as the lubricants for refrigerating machines using the FLON refrigerant, there have been used mineral oils such as a naphthene and a paraffin as well as synthetic oils such as an alkylbenzene, a polyglycol and a poly-α-olefin, but when the base oil is used singly, the lubricating properties are not always sufficient, depending upon conditions to be used.

Thus, in fact, a wear inhibitor such as a phosphate is added to the base oil so as to improve the lubricating properties.

SUMMARY OF THE INVENTION

The present inventors have repeated researches with the intention of developing a lubricant for a refrigerating machine having excellent lubricating properties, and as a result, they have found that a chlorinated polyether having a specific structure, even when used singly, exhibits excellent lubricating properties. The present invention has been completed on the basis of this knowledge.

An object of the present invention is to provide a lubricant for a refrigerating machine having excellent lubricating properties which contains a chlorinated polyether having a specific structure as a main component.

That is, according to the present invention, there is provided a lubricant for a refrigerating machine which comprises a polyether represented by the general formula

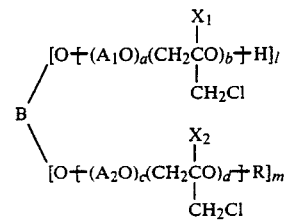

wherein B is a residue of a compound having 2 to 8 hydroxyl groups, $A_1O$ and $A_2O$ may be identical or different, each of them is an oxyalkylene group having 2 to 18 carbon atoms, $X_1$ and $X_2$ may be identical or different, each of them is hydrogen or a methyl group, R is hydrogen or a hydrocarbon group having 1 to 24 carbon atoms, a is an integer of from 0 to 100, b is an integer of from 1 to 100, c is an integer of from 0 to 100, d is an integer of from 0 to 100, the oxyalkylene group and the chlorine-containing group in the parentheses { } may be each combined by random copolymerization or block copolymerization, l is an integer of from 1 to 8, m is an integer of from 0 to 7, and l+m is an integer of from 2 to 8.

The lubricant for a refrigerating machine of the present invention exhibits satisfactory physical and chemical characteristics which are required for the lubricant, and particularly it should be noted that the lubricant of the present case is excellent in lubricating properties.

DETAILED DESCRIPTION OF THE INVENTION

Now, the present invention will be described in more detail.

A lubricant for a refrigerating machine of the present invention comprises a polyether represented by the general formula

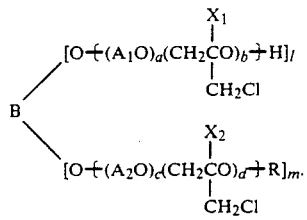

In this formula, B is a residue of a compound having 2 to 8 hydroxyl groups, each of $A_1O$ and $A_2O$ is an oxyalkylene group having 2 to 18 carbon atoms, each of $X_1$ and $X_2$ is hydrogen or a methyl group, R is hydrogen or a hydrocarbon group having 1 to 24 carbon atoms. Each of a, b, c and d is an integer of from 0 to 100, at least one of b and d is not 0, and when $m=0$, $b\neq 0$. The oxyalkylene group and the chlorine-containing group in the parentheses { } may be each combined by random copolymerization or block copolymerization. The symbol l is an integer of from 1 to 8, m is an integer of from 0 to 7, and l+m is an integer of from 2 to 8.

Typical examples of the compound having 2 to 8 hydroxyl groups whose residue is represented by B include polyhydric alcohols such as ethylene glycol, propylene glycol, butylene glycol, trimethylene glycol, tetramethylene glycol, pentamethylene glycol, hexamethylene glycol, heptamethylene glycol, octamethylene glycol, dodecylene glycol, octadecylene glycol, diethylene glycol, neopentyl glycol, styrene glycol, glycerin, diglycerin, polyglycerin, trimethylolethane, trimethylolpropane, 1,3,5-pentanetriol, erythritol, pentaerythritol, dipentaerythritol, sorbitol, sorbitan, sorbite, sorbitol glycerin condensate, adonitol, arabitol, xylitol and mannitol; polyhydric phenols such as catechol, resorcin, hydroquinone and phloroglucin; saccharoses such as xylose, arabinose, ribose, rhamnose, glucose, fructose, galactose, mannose, sorbose, cellobiose, maltose, isomaltose, trehalose, sucrose, raffinose, gentianose and melezitose; and partial ether compounds and partial ester compounds thereof.

Furthermore, examples of $A_1O$ and $A_2O$ include an oxyethylene group, oxypropylene group, oxytrimethylene group, oxybutylene group, 1,2-dimethyloxyethylene group, 1-methyloxytrimethylene group, 2-methyloxytrimethylene group, oxytetramethylene group, oxypentamethylene group, oxyhexamethylene group, oxyheptamethylene group, oxyoctamethylene group, oxynonamethylene group, oxydecamethylene group, oxyundecamethylene group, oxydodecamethylene group, oxytridecamethylene group, oxytetradecamethylene group, oxypentadecamethylene group, oxyhexadecamethylene group, oxyheptadecamethylene group and oxyoctadecamethylene group. Above all, the oxyethylene group, oxypropylene group and oxybutylene group and oxytetramethylene group are more preferable.

Moreover, typical examples of R include various hydrocarbon groups, for example, alkyl groups each having a straight-chain or a branched structure such as a methyl group, ethyl group, propyl group, butyl group, pentyl group, hexyl group, heptyl group, octyl group, nonyl group, decyl group, undecyl group, dodecyl group, tridecyl group, tetradecyl group, pentadecyl group, hexadecyl group, heptadecyl group, octadecyl group, nonadecyl group, eicosyl group, heneicosyl group, docosyl group, tricosyl group and tetracosyl group; alkenyl groups each having a straight-chain or a branched structure such as an ethenyl group, propenyl group, butenyl group, pentenyl group, hexenyl group, heptenyl group, octenyl group, nonenyl group, decenyl group, undecenyl group, dodecenyl group, tridecenyl group, tetradecenyl group, pentadecenyl group, hexadecenyl group, heptadecenyl group, octadecenyl group, nonadecenyl group, eicosenyl group, heneicosenyl group, docosenyl group, tricosenyl group and tetracosenyl group; cycloalkyl groups such as a cyclohexyl group, methylcyclohexyl group and ethylcyclohexyl group; and aromatic groups such as a phenyl group, methylphenyl group, ethylphenyl group, propylphenyl group, butylphenyl group, pentylphenyl group, hexylphenyl group, heptylphenyl group, octylphenyl group, nonylphenyl group, decylphenyl group, undecylphenyl group, dodecylphenyl group, tridecylphenyl group, tetradecylphenyl group, pentadecylphenyl group, hexadecylphenyl group, heptadecylphenyl group, octadecylphenyl group, naphthyl group, methylnaphthyl group, ethylnaphthyl group, propylnaphthyl group, butylnaphthyl group, pentylnaphthyl group, hexylnaphthyl group, heptylnaphthyl group, octylnaphthyl group, nonylnaphthyl group, decylnaphthyl group, undecylnaphthyl group, dodecylnaphthyl group, tridecylnaphthyl group and tetradecylnaphthyl group.

In one molecule of the polyether or in one polyether chain regarding the present invention, different oxyalkylene groups and different chlorine-containing groups (groups represented by

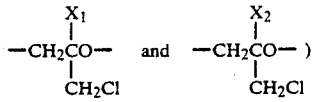

may be present. In this case, these groups in the one polyether chain may be combined by random copolymerization or block copolymerization.

No particular restriction is put on the molecular weight of the polyether, but for the improvement of sealing properties of the compressor, the polyether having a number average molecular weight of from 200 to 4,000 is preferably used, and a number average molecular weight of from 300 to 3,500 is more preferable.

As the lubricant for a refrigerating machine of the present invention, there may be used the above-mentioned polyether singly, but a known base oil for a refrigerating machine may be mixed therewith, if necessary. Examples of the preferable base oil include polyglycol oils such as polyoxyalkylene glycol, polyoxyalkylene glycol monoether, polyoxyalkylene glycol diether and polyoxyalkylene glycol glycerol ether, and other oils can also be used which are mineral oils such as a paraffin and a naphthene as well as polyα-olefins and alkylbenzenes. These oils may be used singly or in the form of a mixture of several kinds thereof.

No particular restriction is put on the amount of the above-mentioned base oil to be blended, so long as it is not such as to impair the excellent performance of the lubricant for a refrigerating machine of the present invention. Nevertheless, the amount of the base oil is usually 50% by weight or less, preferably 30% by weight or less based on the total weight of the lubricant.

In addition, for the purpose of further improving the performance of the lubricant for a refrigerating machine of the present invention, known additives for a refrigerating machine oils can be blended, if necessary. Examples of these additives include a phenol antioxidant such as di-tert-butyl-p-cresol or an amine antioxidant such as phenyl-α-naphthylamine or N,N'-di(2-naphthyl)-p-phenylenediamine; a wear inhibitor such as zinc dithiophosphate, a phosphate or a chlorinated phosphate; an extreme pressure additive such as a chlorinated paraffin or a material containing sulfur; an oiliness improver such as a fatty acid; an antifoaming agent such as a silicone material; a metal inactivating agent such as benzotriazole; and a hydrochloric acid trapping agent such as a phenyl glycidyl ether, an epoxidized aliphatic acid ester, an epoxidized vegetable oil, a glycidyl methacrylate or a phosphite. They can be blended singly or in the form of a mixture of several kinds thereof.

The amount of the additives to be blended is usually 10% by weight or less, preferably 5% by weight or less based on the total weight of the lubricant.

The lubricant for a refrigerating machine of the present invention which comprises a polyether should have about the same kinematic viscosity and pour point as the usual oil for a refrigerating machine has. However, in order to prevent the solidification of the lubricant at a low temperature, it is desirable that the pour point is −10° C. or less, preferably in the range of from −20° to −50° C. Furthermore, in order to maintain sealing properties of a compressor, it is desirable that the kinematic viscosity of the lubricant is 2 cSt or more, preferably 3 cSt or more at 100° C. Considering flowability at a low temperature and the efficiency of heat exchange in a carburetor, it is desirable that the kinematic viscosity of the lubricant is 50 cSt or less, preferably 20 cSt or less at 100° C.

The lubricant for a refrigerating machine of the present invention is particularly effective in using a refrigerant containing a less amount of chlorine in the molecule thereof such as HCFC typified by R22 and R142b, and HFC typified by R134a, and the lubricant of the present case is also effective in using the other refrigerants.

The lubricant for a refrigerating machine of the present invention can be used particularly preferably in a cooling device of an air conditioner, a dehumidifier, a refrigerator, a freezer, a freezing and refrigerating chamber, an automatic vending machine, a showcase or a chemical plant having a rotary type compressor. The lubricant of the present case can also be used preferably in devices having a reciprocating and a centrifugal type compressor.

Now, the present invention will be described in more detail in reference to examples and comparative examples.

EXAMPLES 1 TO 4 AND COMPARATIVE EXAMPLES 1 TO 4

Table 1 shows the kinematic viscosities and pour points of lubricants for refrigerating machines used in examples and comparative examples.

For these lubricants for refrigerating machines, load resistance was evaluated in accordance with a FALEX test. The results are also set forth in Table 1.

FALEX Test

Baking load was measured at an initial oil temperature of 25° C. and through a warming operation of 250 lb for 5 minutes in accordance with ASTM D 3233. During this measurement, each lubricant sample in which predetermined refrigerants (R12 and R134a) were sufficiently dissolved was blown at a flow rate of 10 liters/minute. However, in Comparative Examples 3 and 4, R134a which could not be dissolved in the lubricant sample was replaced with R22.

TABLE 1

| Example & Comp. Ex. | Compound | Kinematic[1] Viscosity at 100° C. (cSt) |
|---|---|---|
| Example 1 | Polyoxypropylene glycol monochlorohydrine[3] | 13.1 |
| Example 2 | Polyoxyethyleneoxy-propylene glycol monochlorohydrine[4] | 9.9 |
| Example 3 | Polyoxypropylene glycol dichlorohydrine[5] | 16.4 |
| Example 4 | Polyoxyethylene-oxypropylene glycol dichlorohydrine[6] | 31.1 |
| Example 5 | Glycerin derivative[7] | 13.5 |
| Example 6 | Pentaerythritol derivative[8] | 19.2 |
| Comp. Ex. 1 | Polyoxypropylene glycol monobutyl ether | 6.9 |
| Comp. Ex. 2 | Polyoxyethyleneoxy-propylene glycol monobutyl ether | 10.7 |
| Comp. Ex. 3 | Naphthene mineral oil | 7.8 |
| Comp. Ex. 4 | Alkylbenzene oil | 4.4 |

| Example & Comp. Ex. | Pour Point[2] °C. | FALEX Baking Test Refrigerant | Baking Load (lb) |
|---|---|---|---|
| Example 1 | −40 | R12 | 1050 |
| | | R134a | 910 |
| Example 2 | −45 | R12 | 1050 |
| | | R134a | 900 |
| Example 3 | −37.5 | R12 | 1260 |
| | | R134a | 1050 |
| Example 4 | −32.5 | R12 | 1300 |
| | | R134a | 1120 |
| Example 5 | −37.5 | R12 | 1220 |
| | | R134a | 1030 |
| Example 6 | −27.5 | R12 | 1200 |
| | | R134a | 990 |
| Comp. Ex. 1 | −47.5 | R12 | 850 |
| | | R134a | 740 |
| Comp. Ex. 2 | −45 | R12 | 900 |
| | | R134a | 830 |
| Comp. Ex. 3 | −22.5 | R12 | 640 |
| | | R22 | 620 |
| Comp. Ex. 4 | −42.5 | R12 | 620 |
| | | R22 | 600 |

[1] It was measured in accordance with JIS K 2283
[2] It was measured in accordance with JIS K 2269

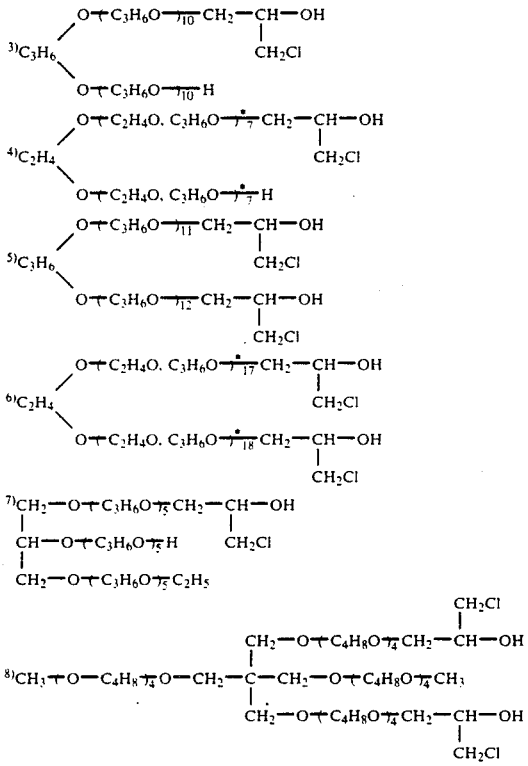

Here, * represents a random copolymerization, and the molar ratio of $C_2H_4O/C_3H_6O$ was 1/1.

The results in Table 1 indicate that the lubricants for refrigerating machines regarding the present invention, baking loads are larger as compared with the lubricants for refrigerating machines shown in Comparative Examples 1 to 4, which means that the lubricants of the present case have excellent load resistance.

As discussed above, the lubricant for a refrigerating machine of the present invention is particularly excellent in lubricating properties and other various performances.

What is claimed is:

1. A lubricant for a refrigerating machine which comprises a polyether represented by the general formula

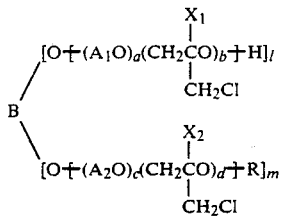

wherein B is a residue of a compound having 2 to 8 hydroxyl groups, $A_1O$ and $A_2O$ may be identical or different, each of them is an oxyalkylene group having 2 to 18 carbon atoms, $X_1$ and $X_2$ may be identical or different, each of them is hydrogen or a methyl group, R is hydrogen or a hydrocarbon group having 1 to 24 carbon atoms, a is an integer of from 0 to 100, b is an integer of from 1 to 100, c is an integer of from 0 to 100, d is an integer of from 0 to 100, the oxyalkylene group and the chlorine-containing group in the parentheses { } may be each combined by random copolymerization or block copolymerization, l is an integer of from 1 to 8, m is an integer of from 0 to 7, and l+m is an integer of from 2 to 8.

2. The lubricant for a refrigerating machine according to claim 1 which has a pour point of −10° C. or less.

3. The lubricant for a refrigerating machine according to claim 1 which has a kinematic viscosity of from 2 to cSt at 100° C.

* * * * *